US007358841B2

(12) United States Patent
Kamio

(10) Patent No.: US 7,358,841 B2
(45) Date of Patent: Apr. 15, 2008

(54) CORE AND INDUCTOR HAVING THE CORE

(75) Inventor: Yuichi Kamio, Tokyo (JP)

(73) Assignee: Sumida Corporation (JP)

( * ) Notice: Subject to any disclaimer, the term of this patent is extended or adjusted under 35 U.S.C. 154(b) by 68 days.

(21) Appl. No.: 11/458,450

(22) Filed: Jul. 19, 2006

(65) Prior Publication Data

US 2007/0018770 A1 Jan. 25, 2007

(30) Foreign Application Priority Data

Jul. 19, 2005 (JP) ..... 2005-208243

(51) Int. Cl.
*H01F 27/02* (2006.01)
*H01F 27/29* (2006.01)

(52) U.S. Cl. ..... 336/83; 336/200; 336/192

(58) Field of Classification Search ..... 336/212, 336/83, 192, 200
See application file for complete search history.

(56) References Cited

U.S. PATENT DOCUMENTS

2003/0179062 A1* 9/2003 Kuwata et al. ..... 336/83

FOREIGN PATENT DOCUMENTS

JP 2001338817 A * 12/2001
JP 2003109823 A * 4/2003
JP 2003-257741 9/2003

* cited by examiner

*Primary Examiner*—Anh Mai
(74) *Attorney, Agent, or Firm*—Stephen Chin; von Simson & Chin, LLP

(57) ABSTRACT

The present invention prevents poor contact of a core and an inductor with a substrate as well as improves the strength of attachment of such core and inductor to the substrate. A core mounted on a substrate is having one or more electrode forming parts. The electrode forming parts comprise: a convex part having a peak surface that is projecting from an end surface of the core, the most projecting portion and is shaped flat and a step part formed from the outer rim of the peak surface to the end surface of the core; and an electrically conductive coating formed on the surface of the peak surface and on the surface of the step part.

16 Claims, 4 Drawing Sheets

CORE AND INDUCTOR HAVING THE CORE

CLAIM OF PRIORITY

This application claims the benefit of Japanese Patent Application No. 2005-208243 filed on Jul. 19, 2005, the entire contents of which are hereby incorporated by reference herein.

BACKGROUND OF THE INVENTION

1. Field of the Invention

The present inventions relate to a core and an inductor used in a variety of electronic devices and electrical appliances, such as mobile phones, personal computers and televisions.

2. Description of the Related Invention

Conventionally, a surface mount-type inductor exists in which a ring core is disposed so as to cover the outside of a drum core around which a winding is wound, with electrodes formed directly by plating and the like on an end surface of such ring core. As this type of inductor, the inductor disclosed in for example, Japanese Patent Application Laid-Open No. 2003-257741 is known.

The inductor disclosed in No. 2003-257741 provides a convex part on the core's end surface, with the electrodes formed by applying an electrically conductive paste or the like to such convex part.

However, with the inductor disclosed in No. 2003-257741, the convex part of the electrode portion has a peak surface and lateral side surfaces, such that a boundary between the peak surface and the lateral side surface forms an edge, and it is desirable that the attachment between the inductor and the substrate described in No. 2003-257741 is more strengthened and that it is made more difficult for the electrode to peel off from such edge portion.

SUMMARY OF THE INVENTION

Accordingly, the present invention is conceived in light of the foregoing circumstances, and has as its object to make the attachment of the core to the substrate stronger and to provide a core more difficult to peel off and an inductor having the core.

To achieve the foregoing object, the present invention provides a core mounted on a substrate, having one or more electrode forming parts comprising:

a convex part having a peak surface that is projecting from an end surface of the core, the most projecting portion and is shaped flat and a step part formed from the outer rim of the peak surface to the end surface of the core; and an electrically conductive coating formed on the surface of the peak surface and on the surface of the step part.

With such a construction, because the electrode is formed on the top part and the step part of the convex part, the core can be attached to the substrate over a wide surface area by an electrically conductive fusing material such as solder, enabling poor contact between the core and substrate to be prevented and strengthening the attachment of the core to the substrate.

According to one aspect of the invention, the outer rim of the peak surface that forms the boundary between the peak surface and the step part is a curve having a radius R. With such a construction, since the outer rim of the peak surface is a curve having a radius R, a gap is created between the outer rim portion and the substrate when the core is set on the substrate. Consequently, when the core is fixedly mounted on the substrate with solder or the like, the solder gets into this gap and a so-called solder fillet is formed. Thus the strength of the attachment of the core to the substrate is further improved.

In addition, the present invention provides an inductor in which the core described above is a ring core, comprising a drum core disposed within the ring core around which a winding is wound, with the ends of the winding connected to the electrode forming part. With such a construction, an inductor is formed by disposing within the ring core a drum core around which the winding is wound. Consequently, when the inductor is fixedly mounted on the substrate with solder or the like, the solder gets into this gap and a so-called solder fillet is formed. Thus, the strength of the attachment of the core to the substrate is further improved.

According to another aspect of the invention, the step part is a slanted surface. As a result, an electrically conductive fusing material such as solder exists in the space between the slanted surface and the substrate. Thus, it is possible to strongly attach the inductor to the substrate and to provide good electrical contact.

According to another and further aspect of the invention, the drum core is a manganese-type ferrite core.

According to yet another and further aspect of the invention, the ring core is a nickel-type ferrite core.

According to still another and further aspect of the invention, an inductor has the above-described drum core which forms an insulating layer on the surface of the drum core.

The present invention makes the attachment of the core and the inductor to the substrate stronger and provides an inductor and a core more difficult to peel off.

Other objects, features and advantages of the present invention will be apparent from the following description when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

A description will now be given of a preferred embodiment of the present invention, using FIGS. 1-7.

Figure 1:
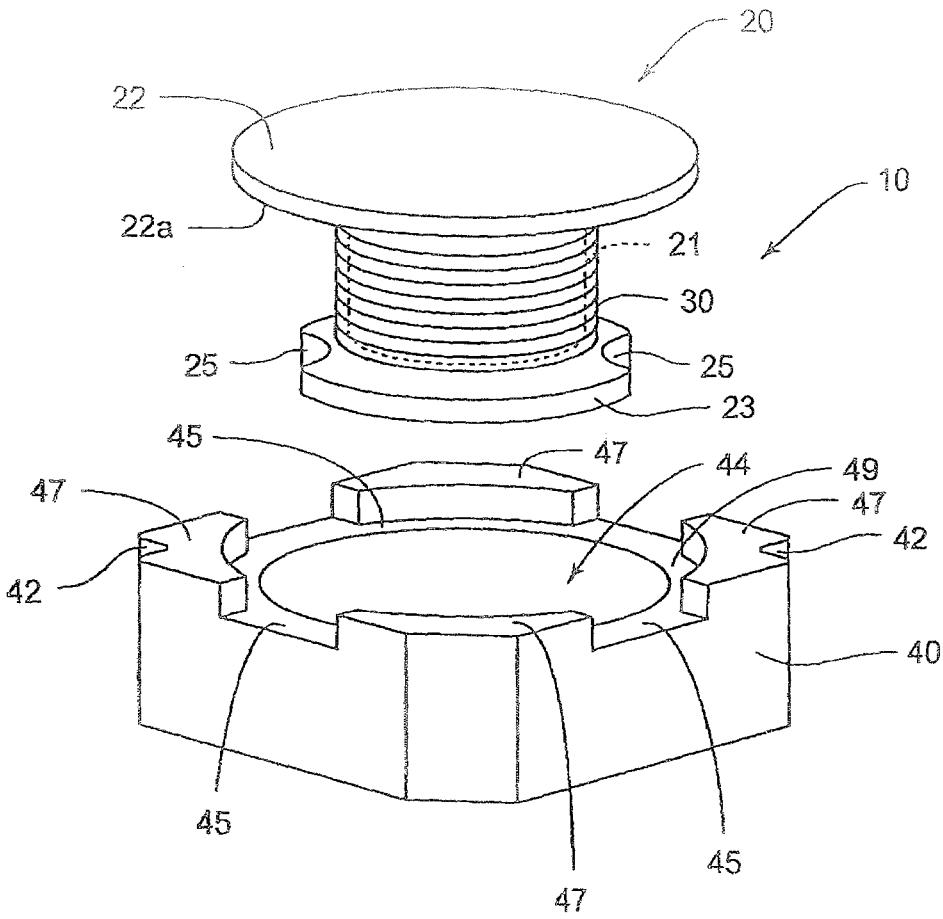
FIG. 1 is an exploded perspective view showing the construction of an inductor according to a first embodiment of the present invention, with its non-mounting surface facing up.
Figure 2:
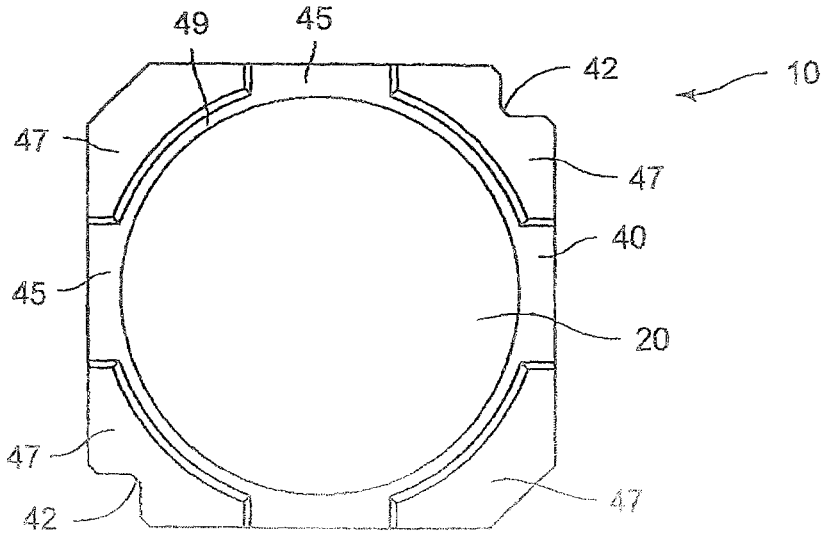
FIG. 2 is a plan view showing the inductor shown in FIG. 1 as seen from its non-mounting surface.
Figure 3:
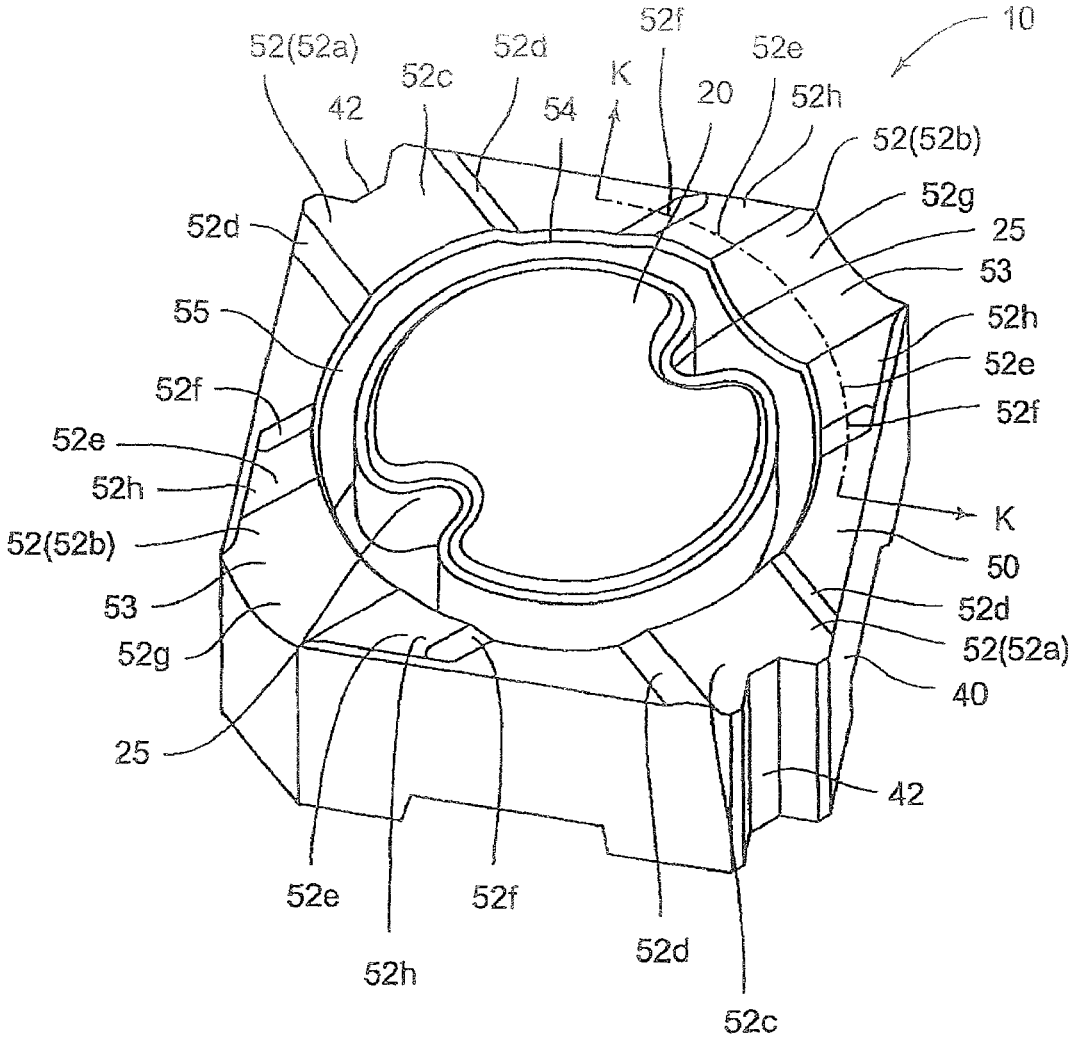
FIG. 3 is a perspective view showing the inductor shown in FIG. 1 with its mounting surface facing up.
Figure 4:
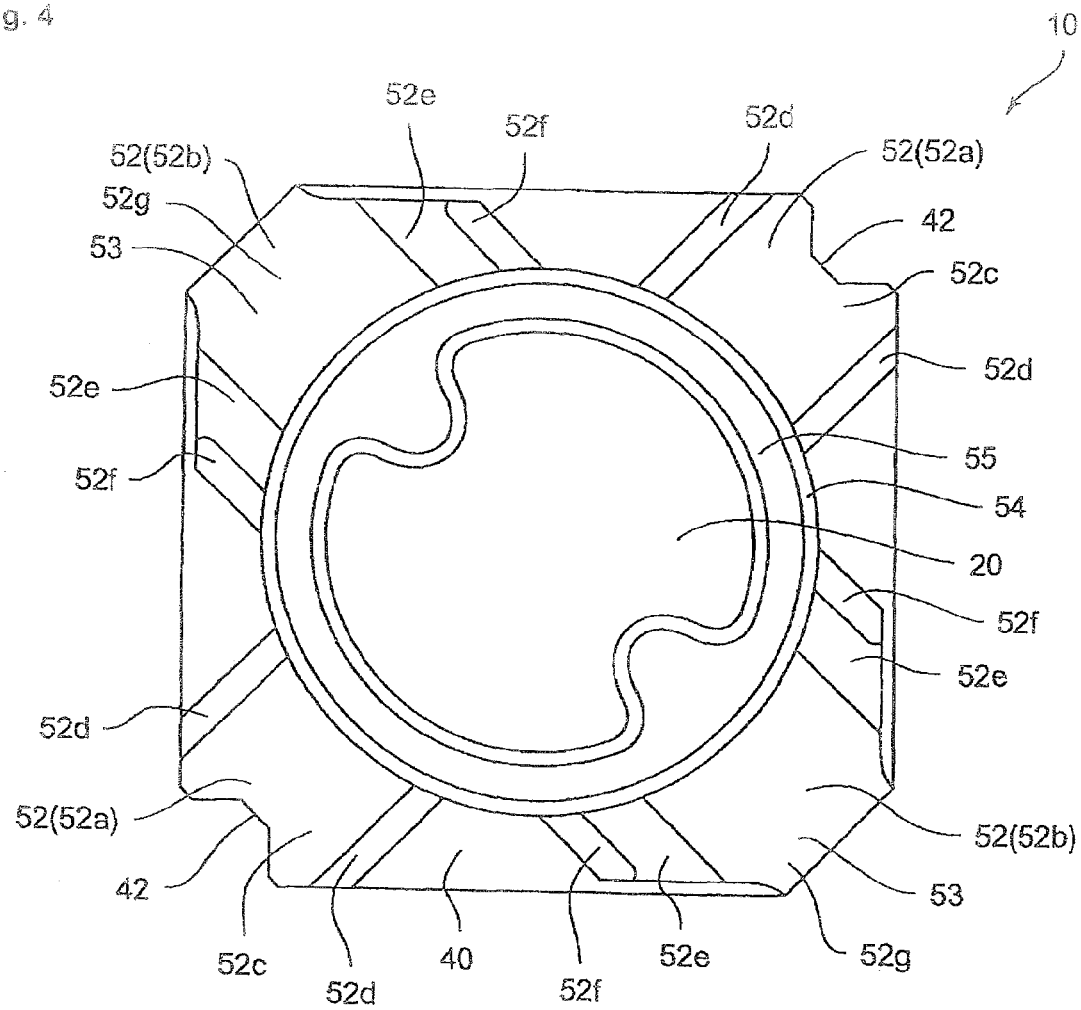
FIG. 4 is a plan view showing the inductor shown in FIG. 1 as seen from its mounting surface.
Figure 5:
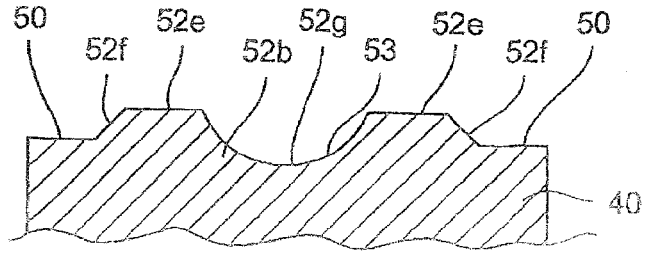
FIG. 5 is a sectional view of the inductor shown in FIG. 3 along a line K-K, in the area of an electrode convex part.
Figure 6:
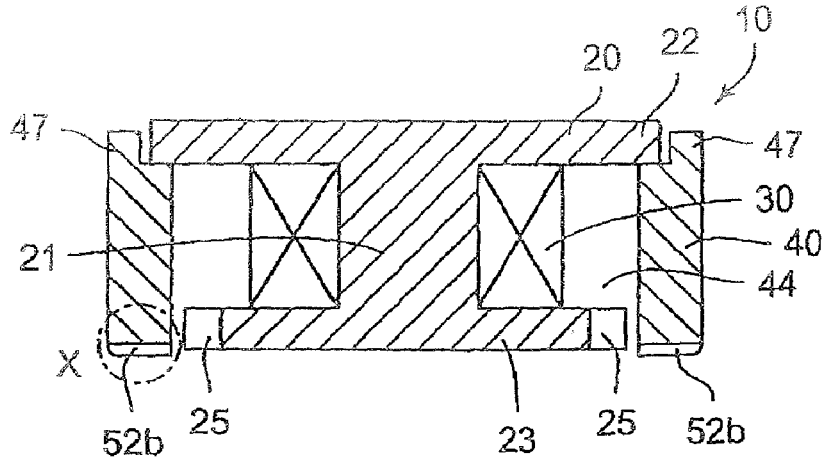
FIG. 6 is a sectional side view of the inductor shown in FIG. 1.
Figure 7:
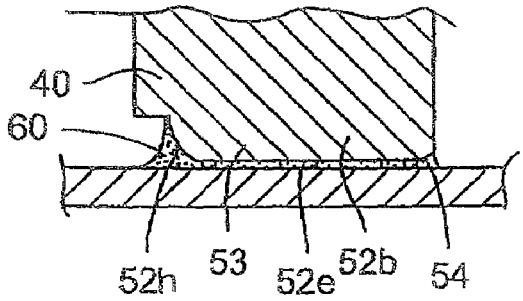
FIG. 7 is a partly sectioned view of an electrode forming part in a case in which the inductor shown in FIG. 1 is mounted on a substrate.

The inductor according to the present invention is a surface mount-type inductor. FIG. 1 is an exploded perspective view showing the construction of an inductor 10 according to a first embodiment of the present invention, with its non-mounting surface facing up. FIG. 2 is a plan view showing the inductor 10 shown in FIG. 1 as seen from its non-mounting surface. FIG. 3 is a perspective view showing the inductor 10 shown in FIG. 1 with its mounting surface facing up. FIG. 4 is a plan view showing the inductor 10 shown in FIG. 1 as seen from its mounting surface. FIG. 5 is a sectional view of the inductor 10 shown in FIG. 3 along a line K-K, in the area of an electrode convex part 52*b*. FIG. 6 is a sectional side view of the inductor 10. FIG. 7 is a partly sectioned view of an electrode forming part 53 in a case in which the inductor 10 is mounted on a substrate, showing an expanded view of a portion indicated by X in FIG. 6. It should be noted that, in the following description, a top longitudinal side (top end longitudinal side) indicates a side on which a top flange 22 described later is present, and a bottom longitudinal side (bottom end longitudinal side) indicates a side on which a bottom flange 22 described later is present.

As described above, the inductor 10 is a surface mount-type inductor, primarily comprises a drum core 20, a winding 30 made by copper and a ring core 40.

The drum core 20 is disposed inside the ring core 40. As shown in FIG. 1, the drum core 20 has a columnar winding shaft 21, and a substantially disc-like top flange 22 and a substantially disc-like bottom flange 23 formed on both top and bottom ends of the winding shaft 21. The outer diameter of the top flange 22 is greater than the outer diameter of the bottom flange 23. The drum core 20 is formed from magnetic material such as electrically conductive manganese-type ferrite. In addition, an insulating layer, not shown, is formed on the surface of the drum core 20 by coating the surface of the drum core 20 with a non-conductive, non-magnetic polyimide insulating paint.

As shown in FIG. 1, the winding 30 is wound around the outer periphery of the winding shaft 21. Grooves 25 for drawing out the ends of the winding 30 are formed at two places disposed opposite each other on a lateral side surface of the bottom flange 23. The grooves 25 are cut out of the bottom flange 23 so as to be substantially elliptical in shape toward the center of the winding shaft 21. Although in the present embodiment the diameter of the winding 30 is 0.02-0.04 mm, it is to be understood that the diameter of the winding in the present invention is not limited thereto.

The ring core 40, as shown in FIG. 1, is substantially a square column in shape formed from a magnetic material such as nickel-type ferrite. Notched parts 42 cut in the shape of semi-hexagons are formed on two opposed corner parts of the substantially square column of the ring core 40, with an accommodation part 44 that becomes a columnar open part for accommodating the drum core 20 and the winding 30 formed in the center. Convex parts 47 that project upward from the top surface 45 of the ring core 40 are formed at the four corners of the top surface 45 of the ring core 40. As a result, a step part 49 is formed by the convex parts 47 and the top surface 45. The inner periphery of the convex parts 47 form parts of a circular circumference, and the circle thus formed by the inside of the convex parts 47 has a diameter that is greater than the diameter of the top flange 22. In addition, the diameter of the accommodation part 44 is less than the diameter of the top flange 22 but greater than the diameter of the bottom flange 23. Therefore, by inserting the drum core 20 into the accommodation part 44 from the bottom flange 23 side, a bottom surface 22*a* of the top flange 22 contacts the step part 49 so that the drum core 20 is accommodated within the accommodation part 44.

As shown in FIG. 3, four convex parts 52 are provided on the four corners of the bottom surface 50 that is the mounting surface of the ring core 40. Hereafter, of the convex parts 52, those provided on the sides on which the notched parts 42 are formed are auxiliary convex parts 52*a*, and those provided on the sides on which the notched parts 42 are not formed are the electrode convex parts 52*b*. A slope 54 that extends across the convex parts 52 as well is formed on the outer peripheral part of the accommodation part 44. The auxiliary convex parts 52*a* extend vertically from the bottom surface 50 of the ring core 40, with the most projecting portions forming peak surfaces 52*c* that are horizontal with respect to the bottom surface 50. Step parts 52*d* that slant outward from the outer edges of the peak surfaces 52*c* toward the top surface 45 are formed on both lateral sides of each peak surface 52*c* along a diagonal line that connects the two auxiliary convex parts 52*a*. In addition, as described above, the slope 54 is formed on the accommodation part 44 side of the auxiliary convex part 52*c*.

As shown in FIG. 3 and FIG. 5, the electrode convex parts 52*b* project vertically from the bottom surface 50 from positions at which the notched parts 42 at the four corners of the ring core 40 are not formed. In addition, the most projecting portions of the electrode convex parts 52*b* form peak surfaces 52*e* that are horizontal with respect to the bottom surface 50. Furthermore, step parts 52*f* that slant outward from the outer edges of the peak surfaces 52*e* toward the top surface 45 are formed on both lateral sides of each peak surface 52*e* along a diagonal line that connects the two electrode convex parts 52*b*. In addition, electrode concave parts 52*g* cut out in the form of upwardly open semi-elliptics are formed at substantially the centers of the electrode convex parts 52*b* along a diagonal line that connects the two electrode convex parts 52*b*. In the present embodiment, the heights of the auxiliary convex parts 52*a* and the electrode convex parts 52*b* are 0.1-0.3 mm. However, as can be appreciated by those skilled in the art, the heights of the auxiliary convex parts 52*a* and the electrode convex parts 52*b* of the present invention are not limited thereto.

Furthermore, a portion of the electrode convex part 52*b* corresponding to the outer periphery of the ring core 40 and extending to the step parts 52*f* from the edges of the electrode concave part 52*g* forms a convex curved part 52*h* having a convexly curved surface. Each convex curved part 52*h* is formed from a position located just inside the outer peripheral part of the ring core 40 to the peak surface 52*e*. In other words, in the ring core 40 the bottom surface 50 is present on the outer periphery of the convex curved part 52*h*. In addition, since the bottom surface 50 side of the inductor 10 is mounted on the substrate, in order to stabilize the inductor during mounting, the height of the peak surfaces 52*c* of the auxiliary convex parts 52*a* and the height of the peak surfaces 52*e* of the electrode convex parts 52*b* are identical. Moreover, as with the auxiliary convex parts 52*c*, a slope 54 is formed on the accommodation part 44 side of the electrode convex parts 52*b*.

The electrode convex parts 52*b* are the electrode forming parts 53, which are capable of being electrically conductive with the substrate by the formation of a thin film of silver on the surfaces thereof. The thin film of silver is formed on the surface of each electrode convex part 52*b* by such methods as vapor deposition, plating, or the like. Furthermore, as shown in FIG. 3, the drum core 20 is disposed so that the grooves 25 are positioned opposite the electrode concave parts 52*g*. As a result, the ends of the winding 30 drawn from the grooves 25 can be easily positioned atop the electrode concave parts 52*g*. The ends of the winding 30, not shown, are temporarily fixed by plating or the like in place on the electrode concave parts 52*g*. In addition, a gap 55 formed between the drum core 20 and the ring core 40 is filled with an adhesive or the like to fix the drum core 20 and the ring core 40 in place as a single integrated unit.

With the inductor 10 constructed as described above, the step parts 52*f*, the convex curved parts 52*h* and the slope 54 are all formed loosely slope from the peaks 52*e* of the electrode convex parts 52*b* and the electrode convex parts 52*b* become the electrode forming parts 53, and therefore an electrically conductive fusing material such as solder can be used over a wider surface area than in an arrangement in which the step parts 52*f* and the convex curved parts 52*h* are formed at right angles to the peak parts 52*e*. As a result, the surface area for attachment between the inductor 10 and the substrate is increased, thus enabling poor contact between the inductor 10 and substrate to be prevented and thereby strengthening the attachment of the inductor 10 to the substrate.

In addition, with the inductor 10 described above, because the convex curved parts 52*h* are curved surfaces, the boundary between each peak surface 52*e* and the convex curved part 52*h* is a curved surface having a radius R. Therefore, when mounting the inductor 10 on the substrate using solder or the like, as shown in FIG. 7 the solder or the like enters between the substrate and the convex curved parts 52*h* to form a solder fillet 60. As a result, the surface area of attachment between the substrate and the inductor 10 increases and the strength of the attachment of the inductor 10 to the substrate improves. Moreover, when solder or the like is inserted between the step parts 52*f* and the substrate so as to form a solder fillet, it is possible to strengthen further the attachment of the electrode forming parts 53 to the substrate. It should be noted that the mounting of the inductor 10 on the substrate is carried out by reflow.

In addition, with the inductor 10 described above, the boundary between the peak surfaces 52*e* and the convex curved parts 52*h* is a curved surface having a radius R. As a result, the electrode is harder to peel off than when the convex curved part 52*h* is flat without becoming a curved surface and the boundary between the peak surface 52*e* and the convex curved part 52*h* is formed as a straight edge. Thus, it is possible to prevent poor contact between the inductor 10 and substrate.

In addition, with the inductor 10 described above, auxiliary convex parts 52*a* are also formed on the two corners on which the notched parts 42 are formed. Thus, it is possible to contact the inductor 10 on the substrate at all four corners. Accordingly, the electrode forming parts 53 can be mounted on the substrate in a stable state.

Moreover, since a gap 55 is formed between the drum core 20 and the ring core 40 at the bottom of the inductor 10, the inductor 10 is not easily magnetically saturated and has good DC superimposing characteristics.

The foregoing describes one embodiment of the present invention. However, in addition to the foregoing embodiment, a variety of variations, including those described below, are within the scope of the present invention.

In the above-described embodiment, the stepped parts 52*f* are flat slanted surfaces. However, the present invention is not limited thereto, and alternatively, the stepped parts 52*f* may have a convex curved slanted surface. In addition, by making at least one of the step part 52 and the convex curved part 52*h* formed on the electrode convex part 52*b* into a convex curved slanted surface, a solder fillet 60 may be formed on just a portion of a lateral side surface of the electrode convex part 52*b*.

In addition, in the above-described embodiment, the electrodes are formed by depositing a thin film of silver on the electrode convex parts 52*b*. Alternatively, however, the electrodes may be formed by later mounting a metal hoop or the like, without forming the electrodes in advance. Moreover, the material for the electrodes is not limited to silver, and alternatively, other metals may be used, including zinc and nickel.

In addition, although in the above-described embodiment, the electrode forming part 53 is formed by vapor deposition, plating or the like, alternatively, the electrodes may be formed application of an electrically conductive paste, by printing, by injection, by thermal oxidation, or by some other methods.

In addition, although in the above-described embodiment the drum core 20 is a manganese-type ferrite core, alternatively, the core material may be nickel-type ferrite, silicon steel sheet, Sendust, permalloy or the like.

Similarly, although in the above-described embodiment the ring core 40 is a nickel-type ferrite core, alternatively, the core material may be manganese-type ferrite, silicon steel sheet, Sendust, permalloy or the like.

In addition, although in the above-described embodiment there are four convex parts 52, the present invention is not limited to such a number and alternatively there may be three or fewer, or five or more, convex parts 52.

In addition, although in the above-described embodiment the core that is accommodated within the accommodation part 44 is the drum core 20, the present invention is not limited to such an arrangement. Alternatively, the core may be a bar-shaped core, a T core, a LP core or the like. Moreover, the ring core 40 disposed outside the drum core 20 may be a core with a bottom.

In addition, although in the above-described embodiment the slope 54 has a flat slanted surface, alternatively, the slope 54 may have a convex curved surface.

The inductor of the present invention can be used in a variety of electronic devices and electrical appliances, such as mobile phones, personal computers and televisions.

As many apparently widely different embodiments of the present invention can be made without departing from the spirit and scope thereof, it is to be understood that the invention is not limited to the specific embodiments thereof except as defined in the appended claims.

What is claimed is:

1. A core mounted on a substrate, having an electrode forming part, the electrode forming part comprising of a convex part having a peak surface that is projecting from an end surface of the core, wherein the most projecting portion of the peak surface is flat;

a step part formed from the outer rim of the peak surface to the end surface of the core; and an electrically conductive coating formed on the surface of the peak surface and on the surface of the step part.

2. The core according to claim 1, wherein the outer rim of the peak surface that forms the boundary between the peak surface and the step part is a curve having a radius R.

3. The core according to claim 2 wherein the step part is a slanted surface.

4. The core according to claim 1 wherein the step part is a slanted surface.

5. An inductor comprising:

a core mounted on a substrate, having an electrode forming part, the electrode forming part comprising of a convex part having a peak surface that is projecting from an end surface of the core, wherein the most projecting portion of the peak surface is flat;

a step part formed from the outer rim of the peak surface to the end surface of the core;

an electrically conductive coating formed on the surface of the peak surface and on the surface of the step part, and wherein the core is a ring core, comprising of a drum core disposed within the ring core around which a winding is wound, with the ends of the winding connected to the electrode forming part.

6. The inductor according to claim 5, wherein an insulating layer is formed on the surface of the drum core so as to coat the drum core.

7. The inductor according to claim 5, wherein the drum core is a manganese-type ferrite core.

8. The inductor according to claim 7, wherein an insulating layer is formed on the surface of the drum core so as to coat the drum core.

9. The inductor according to claim 5, wherein the ring core is a nickel-type ferrite core.

10. The inductor according to claim 9, wherein an insulating layer is formed on the surface of the drum core so as to coat the drum core.

11. The inductor as recited in claim 5, wherein the outer rim of the peak surface that forms the boundary between the peak surface and the step part is a curve having a radius R.

12. The inductor according to claim 11, wherein an insulating layer is formed on the surface of the drum core so as to coat the drum core.

13. The inductor according to claim 5, wherein the drum core is a manganese-type ferrite core.

14. The inductor according to claim 13, wherein an insulating layer is formed on the surface of the drum core so as to coat the drum core.

15. The inductor according to claim 11, wherein the ring core is a nickel-type ferrite core.

16. The inductor according to claim 15, wherein an insulating layer is formed on the surface of the drum core so as to coat the drum core.

* * * * *